United States Patent [19]

Wall

[11] Patent Number: 4,922,559

[45] Date of Patent: May 8, 1990

[54] PUBLIC SANITARY CUBICLE

[76] Inventor: Hans Wall, St. Barbara Str. 52, 7517 Waldbronn, Fed. Rep. of Germany

[21] Appl. No.: 272,754

[22] PCT Filed: Feb. 12, 1988

[86] PCT No.: PCT/EP88/00103

§ 371 Date: Oct. 11, 1988

§ 102(e) Date: Oct. 11, 1988

[87] PCT Pub. No.: WO88/06212

PCT Pub. Date: Aug. 25, 1988

[30] Foreign Application Priority Data

Feb. 12, 1987 [DE] Fed. Rep. of Germany ..... 3704375

[51] Int. Cl.[5] ..... A47K 4/00

[52] U.S. Cl. ..... 4/662

[58] Field of Search ..... 4/233, 662

[56] References Cited

U.S. PATENT DOCUMENTS

| | | | |
|---|---|---|---|
| 4,210,973 | 7/1980 | Decaux | 4/662 X |
| 4,301,558 | 11/1981 | Decaux | 4/662 X |
| 4,597,114 | 7/1986 | Paterlini | 4/662 |

FOREIGN PATENT DOCUMENTS

| | | | |
|---|---|---|---|
| 0059134 | 9/1982 | European Pat. Off. | 4/662 |
| 2851036 | 6/1979 | Fed. Rep. of Germany . | |
| 3022778 | 12/1981 | Fed. Rep. of Germany | 4/662 |
| 2123046 | 1/1984 | United Kingdom . | |
| 8807609 | 10/1988 | World Int. Prop. O. | 4/233 |

*Primary Examiner*—Charles E. Phillips

*Attorney, Agent, or Firm*—Antonelli, Terry & Wands

[57] ABSTRACT

A public sanitary cubicle comprises a sanitary room with a water closet accessible through an outer door and a cleaning room separated therefrom by a partition and which contains the means necessary for the supply, disposal and cleaning of the sanitary room, particularly a cleaning appliance which can be brought up to the water closet after moving away the partition or part thereof and a drain connected to the water closet. For improving and facilitating cleaning work, the water closet has a substantially flat base with a rear drainage edge and which is inclined from the sanitary room to the partition, as well as a rear wall formed by the partition or its movable part, the drain being located in the cleaning room in the vicinity of the partition below the drainage edge of the base of the water closet and is exposed by moving away the partition or its movable part.

21 Claims, 4 Drawing Sheets

PUBLIC SANITARY CUBICLE

FIELD OF INVENTION

The invention relates to a public sanitary cubicle comprising a sanitary room with a water closet accessible through an outer door and a cleaning room divided off by a partition from the sanitary room and which is provided with the means necessary for the supply, disposal and cleaning of the sanitary room and in particular a cleaning implement which can be brought up to the water closet after moving away the partition or a part thereof and a drain connected to the water closet.

BACKGROUND AND SUMMARY OF INVENTION

Sanitary cubicles of the aforementioned type have of late been set up at busy points in cities. They are constructed as a type of spatial cell and generally comprise a reinforced concrete body with a trough-like base and a roof mounted thereon. The reinforced concrete body is internally subdivided into two rooms, namely the sanitary room and the cleaning room, at least the sanitary room being provided with its own inner wall structure, e.g. of high-grade steel, aluminium or plastic in order to satisfy hygienic requirements. The sanitry room is provided with a water closet or lavatory pan, a washbasin with mirror and optionally with depositing points and is equipped with a generally arcuately guided outer door, which closes a cutout in the reinforced concrete body. The cleaning room contains all the functional parts for supply, disposal and cleaning purposes. This cleaning room generally has a separate access door for maintenance and repair purposes.

Access to sanitary cubicles of this type is by inserting a coin, which unlocks the outer door and possibly sets into operation certain operational parts such as flushing, exhaust ventilation, etc. When the user leaves the sanitary room, generally automatically the cleaning thereof is commenced and this in particular involves a complete cleaning of the water closet and the washbasin. The cleaning cycle also includes a drying process, so that following users are provided with a clean, dry sanitary room. The outer door remains locked during the cleaning cycle. At the end of the cleaning cycle unlocking automatically takes place, so that the outer door can again be opened by inserting a coin. The drain of sanitary cubicles of this type at the point of installation is directly connected to the sewer, so that in normal operation it can function in maintenance-free manner as an autonomous sanitary unit.

There are essentially three basic constructions for such sanitary cubicles. In the first construction (DE-OS 33 32 356) the sanitary room and the cleaning room are arranged concentrically, all the operational parts being located between the outer shell and the inner shell surrounding the sanitary room. For cleaning purposes corresponding water ducts are passed from the outer shell into the sanitary room and the water is distributed over the water closet, the washbasin and the lower part of the inner wall. Following cleaning with water, a fan blows dry air into the lower region of the sanitary room. This construction does not satisfy the requirements made on public toilets. Thus, due to the special nature of the water supply cleaning is inadequate. No precautions are taken for the case frequently occurring in connection with public toilets of the user throwing objects into the lavatory pan and which, either as a result of their size or their weight, cannot be removed by standard toilet flushing. There is also no removal possibility if objects or waste are placed on the floor. Moreover, due to the conventional construction of the lavatory pan with siphon account is not taken of the always existing risk of blockages.

It is known that a completely satisfactory cleaning of a water closet is not possible by water alone and in fact there must be a mechanical cleaning, e.g. by using brushes. This fact is taken into account by the two other constructions. In one case (EP-OS 0 109 496, DE-OS 28 51 036 and DE-OS 30 27 207) the rear area of the water closet is pivotably mounted on a horizontal spindle. In addition, there is a recess in the lower region of the partition between the sanitary room and the cleaning room, through which the complete water closet can be tilted rearwards into the cleaning room and can be partly supported. Thus, the water closet does not have a direct drain and is instead emptied after pivoting into the cleaning room. Moreover, in the titled position, the water closet comes into contact with revolving brushes, which carry out the necessary mechanical cleaning. The tilting of the toilet content takes place directly into the drain located in the cleaning room. Although to a certain extent this takes adequate account of the hygienic requirements with regards to the lavatory pan, there is no cleaning of the outsides of said pan, as well as adjacent wall areas and the floor, so that objects deposited there are not removed. It is also unsuitable for removing coarse material thrown into the lavatory pan. Admittedly such coarse material can be emptied after tilting the toilet, but then drops into the drain in the cleaning room, which once again leads to a risk of blockages. Finally, the user considers that it is unpleasant for the lavatory pan not to be fixed and instead due to its pivotable mounting and necessary arresting it tends to rock or wobble after a certain amount of time. As a result of the large pivoting radius of the lavatory pan, there must be a corresponding cutout in the partition, which must be sealed in the use position, which causes certain problems.

In the third construction (DE-OS 30 22 778) part of these problems are removed in that the sanitary room is constructed as a cylindrical cabin inserted in the sanitary cubicle, on whose wall is fixed the water closet and which on the opposite side has a cutout corresponding to the outer door of the sanitary cubicle. The water closet is connected by means of a flexible drain pipe to the drain of the sanitary room and provided with a suction or vacuum pump. The cabin is rotatable about a vertical axis in such a way that in the cleaning position the cutout in the cabin wall is directed towards the cleaning room, whilst the water closet on the opposite side is in the vicinity of the outer door. Cleaning appliances, such as brushes and the like can be introduced into the sanitary cabin from the cleaning room through the cabin wall cutout. Different cleaning appliances are provided for the different cleaning processes (inside of the water closet, outside of the water closet and cabin walls) and these are taken up and guided by a robot located in the cleaning room. Although this permits a completely satisfactory cleaning of the sanitary cabin, it involves very considerable constructional expenditure and fault-prone equipment. There is also an increase in the cleaning period involved, because the individual cleaning processes have to be carried out successively.

With the knowledge of the problems resulting from a standard toilet drain or even a corresponding suction system, in one constructional embodiment of the known sanitary cubicle a relatively flat or shallow water closet is provided, which in its rear region is permanently connected to the cleaning room via a wall opening. Through said large-area opening the robot can pass by means of a corresponding arm, so as to firstly transport rearwards through said opening thick and coarse materials from the water closet prior to the turning of the cubicle for the actual cleaning process. Behind the opening in the cleaning room is provided a drain pipe, which leads to the drain. Above the access opening for the drain pipe is arranged a grid or grating, so as to hold back coarse material and pass it into a separate trough. According to a further variant the shallow water closet comprises the actual pan part and the seat frame fitted to the partition. The front of the lavatory pan is pivotably mounted, so that it can be tilted downwards from a use position inclined downwards towards the sanitary room, so that in this way emptying is facilitated by gravity and with the aid of the manipulator. Here again coarse and thick materials, as well as liquid undergo separation by a corresponding grating upstream of the drain pipe. Both constructions suffer from the disadvantage that it is firstly necessary to empty the water closet prior to rotating the cubicle and bringing same into the cleaning position, so that a long time is required for the cleaning process. If excessively large items are thrown into the water closet, in certain circumstances the cleaning arm cannot pass into the same and consequently cannot clean the coarse material therefrom. This leads to the additional risk of operational faults.

The problem of the invention is to so construct a water closet that, in the case of a fixed arrangement thereof, a completely satisfactory, simple cleaning thereof is possible, together with other parts of the sanitary room requiring cleaning and whilst using simple, operationally reliable appliances.

According to a first feature of the invention this problem is solved in that the water closet has a substantially flat base downwardly inclined from the sanitary room to the partition and having a rear drainage edge and a rear wall formed by the partition or its movable part, and that the drain is located in the cleaning room in the vicinity of the partition below the drainage edge of the base of the water closet and is exposed by moving away the partition or its movable part.

The invention differs from the known constructions in that the water closet does not have the conventional construction and instead its shape is adapted to the present circumstances. This is in particular obtained through the flat or planar, rearwardly falling away base and the movable rear wall, as well as by the fact that the water closet does not have a conventional drain or outlet. By moving away the partition or the part thereof forming the water closet rear wall, the water closet is rearwardly open into the cleaning room with a large cross-section, so that as a function of the slope of the base, the content of the water closet largely automatically drains away or drops rearwards and directly into the cleaning room drain located below the drainage edge. Above the drain can be optionally arranged a grating or grid in order to retain coarse material. As a result of the large-area opening of the water closet in the rearwards direction and the planar construction of the water closet base, the inside of the water closet can easily be perfectly cleaned with a simple brush roller or rotary brush moved up to the water closet from the cleaning room.

According to an embodiment of the invention in the lower region of the partition has the movable part which there is a size necessary for forming the rear wall of the lavatory pan, said part being movable into the cleaning room whilst freeing the rear drainage edge of the lavatory pan.

The construction can be such that the cleaning appliance, e.g. a rotary brush simultaneously cleans the inner area of the lavatory pan, as well as the movable partition part, or the latter is cleaned within the cleaning room by a separate cleaning appliance.

In a further variant the movable partition part can be provided at its lower end with a portion inclined downwards into the sanitary room and which forms part of the base of the lavatory pan and whose front edge is connected to its drainage edge. In this variant the bottom of the lavatory pan and the base part on the movable partition part are inclined towards one another and form a gap between them. After removing the partition part the latter and the lavatory pan can be cleaned.

According to another feature of the invention the sanitary room has a movable floor, which can be tilted or moved in the direction of the cleaning room for cleaning purposes.

In the case of a tiltable construction the floor arranged roughly horizontally is tilted rearwards during the cleaning process when the sanitary room is in use, so that water injected into the sanitary room for cleaning the walls or the like can drain away perfectly and objects, paper or the like left on the floor are rinsed away rearwards. In the movable construction the floor can be cleaned during movement or after reaching its end position in the cleaning room. Objects or the like lying on the base are stripped away from the top surface during this movement and drop at the leading edge of the floor into a zone below the sanitary room.

Optionally the movable partition part, which forms the rear termination of the water closet, together with the floor of the sanitary room can be moved towards the cleaning room, in that said two components are appropriately interconnected and joined to a drive.

The cleaning of the movable floor can take place in simple manner by a cleaning appliance arranged below the water closet extending to the floor and which is put into operation when the floor moves past it.

As has already been intimated, it is advantageous to arrange a grating for holding back coarse material above the drain in the cleaning room and this is advantageously inclined into said cleaning room. In a preferred construction said grating is pivotably mounted on the side remote from the water closet and can be pivoted from a position above the drain during the cleaning of the water closet into the cleaning room towards the end of the cleaning process. The coarse material initially retained on the grating is tilted rearwards into the cleaning room after pivoting said grating, so that the latter is again free after pivoting back onto the drain. For this purpose the cleaning room has a collecting trough for coarse material and is emptied every so often.

According to an advantageous embodiment the cleaning appliance for the water closet and for the fixed partition and sanitary room rear wall portions laterally connected thereto is constituted by a rotary brush, which is adapted to the contour of the aforementioned wall parts and is movable along the same over the height of the sanitary cubicle.

As a result of this further feature of the invention not only is the inside of the water closet and the wall area surrounding it which is most exposed to dirt cleaned with water, but they are also cleaned mechanically, which to a particular extent takes account of the hygienic requirements. The rotary brush can be arranged in a chamber above the ceiling of the sanitary room and can be lowered into the sanitary room after opening a ceiling trap or skylight and advantageously runs in guides on opposite side walls of the sanitary room. The rotary brush can be subdivided into portions and they can optionally form different travel paths, e.g. in order to be lowered to the floor.

It is admittedly desirable to clean the walls of the entire sanitary room after use, so that the following user is provided with an absolutely hygienically clean toilet. However, due to the size of the sanitary room this causes problems as regards the cleaning and the subsequently necessary drying. Thus, according to another feature of the invention the facing side walls comprise in each case two cubicle-high wall parts and the two parts of each side wall close to the outer door are mounted there on vertical spindles in such a way that in the sanitary room use position they terminate flush with the two other side wall parts, whilst in the cleaning position they can be swung inwards until they abut, thereby separating with the outer door the access area of the sanitary cubicle from the remaining sanitary room.

Thus, as a result of this inventive construction the sanitary room undergoes a size reduction during the cleaning process by pivoting the side wall parts. This reduced area is then cleaned to the necessary extent, whilst the access area of the sanitary room with the inside of the outer door does not undergo cleaning.

In a modified construction the partition comprises two parts separated in the vertical plane of symmetry of the lavatory pan, which are mounted on vertical spindles and can be pivoted from the use position by 180° into the sanitary room in front of the lavatory pan in such a way that the part of the sanitary room having the latter is separated from the remaining part thereof and is simultaneously opened with respect to the cleaning room.

The partition located behind the fixed lavatory pan consequently forms, after pivoting forwards, a type of screen with respect to the remaining sanitary room and consequently the inside thereof can be easily cleaned from the cleaning room.

According to a further variant the partition forms part of a cylinder forming the entire inner wall of the sanitary room and which is rotatable about a vertical spindle in the sanitary cubicle and has a cutout corresponding with the outer door in the use position and which faces the cleaning room in the cleaning position. This per se known construction (DE-OS 30 22 778) makes possible or necessary a cleaning of the complete sanitary room, which is generally not required.

In the case of the aforementioned constructions, in which the sanitary room or part thereof is open with respect to the cleaning room, the cleaning appliance for the water closet can once again be constituted by a driven rotary brush arranged in the cleaning room.

According to an embodiment, the rotary brush can be located between two support arms mounted in the cleaning room and which, after moving away the partition, can be pivoted towards the water closet and the rotary brush passes into the latter. This leads to a particularly simple and operationally reliable kinematics for the rotary brush.

In a further development of this embodiment the support arms can in each case have an extension extending beyond the mounting support for the rotary brush and which is constructed as a water duct, the extensions or a connection bridging the same can in the cleaning position be located in front of the water closet for the cleaning of the outside thereof.

It is possible in this way simultaneously with the pivoting of the rotary brush into the water closet to bring into the working position a cleaning implement for the outside thereof. For this purpose several water nozzles can be fitted to the extensions of the support arms or the connection bridging the same.

According to another embodiment the rotary brush is mounted in the cleaning room level with the water closet and can be introduced horizontally from the rear into the water closet.

Finally, according to another preferred embodiment the cleaning room contains a water high pressure pump and there are several, optionally movably guided water nozzles for spraying at least part of the inner wall of the sanitary room. Practical tests have shown that a satisfactory cleaning of the sanitary room is only possible with high pressure water.

The invention, is described in greater detail hereinafter relative to embodiments and the attached drawings.

DETAILED DESCRIPTION OF DISCLOSED EMBODIMENTS

Figure 1:
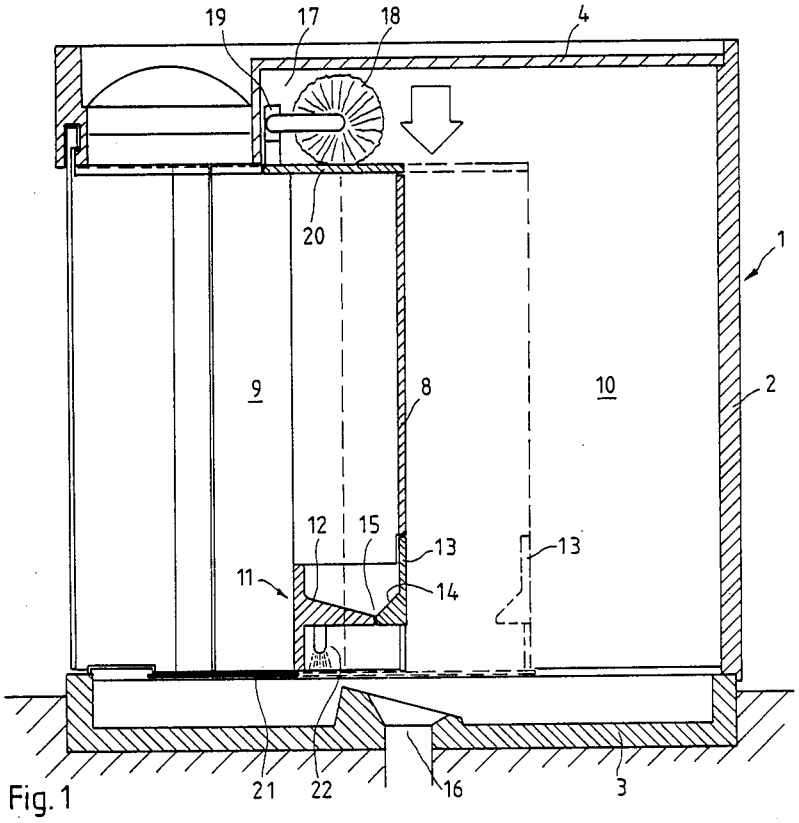
FIG. 1: A side view of a first embodiment of the sanitary cubicle in longitudinal section.

The structure forming the sanitary cubicle 1 comprises a reinforced concrete body 2 forming the outer envelope or sleeve, a base trough 3 and a ceiling 4, which is mounted on the reinforced concrete body 2. As can be gathered from FIG. 2, the latter is elongated and has on its convex narrow side 5 a door-like cutout 6, behind which is arranged an outer door 7 in the form of a sliding door.

The interior of the sanitary cubicle is subdivided by means of a partition 8 into a sanitary room 9 and a cleaning room 10, the latter receiving all the equipment and installation necessary for supply, disposal and cleaning and which are not shown in detail in the drawings.

In the vicinity of the partition 8 in sanitary room 9 is arranged in fixed manner a lavatory pan or water closet 11, whose substantially flat base 12 is inclined rearwardly downwards towards partition 8. The in this case fixed partition 8 has a movable wall part 13, which simultaneously forms the rear termination of the water closet 11 and a forwardly and downwardly inclined portion 14 which, in the use position of the sanitary room 9 reproduced in FIG. 1, is connected to the rear drainage edge 15 of base 12 of water closet 11. The base trough 3 is provided in the vicinity of partition 8 and namely below the drainage edge 15 of base 12 of the water closet 11 with a drain 16, which is connected to the sewer.

Figure 2:
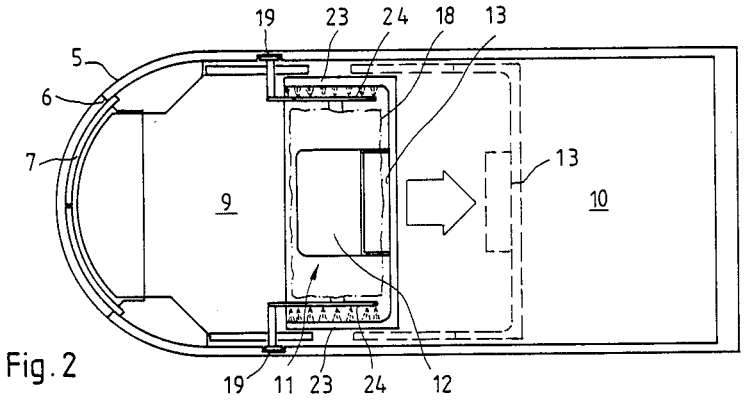
FIG. 2: A plan view of the representation according to FIG. 1 in section.

In the embodiment shown in FIGS. 1 and 2 within the cleaning room 10 in a chamber 17 located above the sanitary room 9 is provided a rotary brush 18, which can be moved up and down in lateral guides 19. Chamber 17 is closed off at the bottom by a skylight cover 20 above which the rotary brush 18 is located in its starting position.

In the position shown in continuous line form in FIGS. 1 and 2 the sanitary room 9 is usable, e.g. by opening the outer door 7 by inserting a coin, thereby giving access. For reasons of completeness only, it is pointed out that the sanitary room 9 can also contain a washbasin, a mirror and a depositing point. In addition, the sanitary room 9 has a movable floor 21.

FIGS. 1 and 2 show in broken line form the cleaning position, which is obtained in that the movable part 13 of partition 8, which simultaneously forms the rear wall of the water closet 11, is moved into the cleaning room 10. In addition, the skylight cover 20 and the floor 21 can be moved in the direction of the cleaning room, in that said three components are constructionally interconnected and therefore jointly driven. On moving into the cleaning position the drainage edge 15 of the water closet 11 is freed, so that its content substantially completely directly drops into the drain 16 as a result of the gradient of base 12. Moreover, during the movement of floor 21 into the broken line position, any objects located thereon are stripped off on the leading edge of the water closet 11 and drop into the base trough 3 of the sanitary cubicle. During movement the floor 21 can be cleaned, in that below the water closet is arranged a cleaning appliance 22, here in the form of one or more spray nozzles. Optionally only part of the floor, e.g. that area located directly in front of and alongside the water closet, is moved rearwards.

On reaching the cleaning position the rotary brush 18 in its guides 19 is moved downwards and cleans partition 8 and the connected side wall parts 23 (FIG. 2), in which the movement of the rotary brush 18 can optionally be accompanied by water spraying means 24. The rotary brush 18 finally reaches its lower position on the base 12 of water closet 11 and removes any dirt left behind there and brushes off the latter rearwards.

At the end of the cleaning process the rotary brush 18 is again moved upwards and the partition part 13, floor 21 and skylight cover 20 are brought into their starting position, where hot air drying of sanitary room 9 takes place by means of a not shown fan.

The embodiment of FIGS. 3 and 4 essentially corresponds to that of FIGS. 1 and 2, so that only the different features will be described. A grating 25 is positioned above drain 16 for retaining coarse material. This grating is pivotably mounted on the side of drain 16 facing the water closet 11 at 26, so that as is indicated by the dot-dash line and arrow, it can be tilted rearwards from the continuously represented operating position. The coarse material held back by it drops into a collecting trough 27 forming part of the base trough 3 and which is emptied from time to time.

Figure 3:
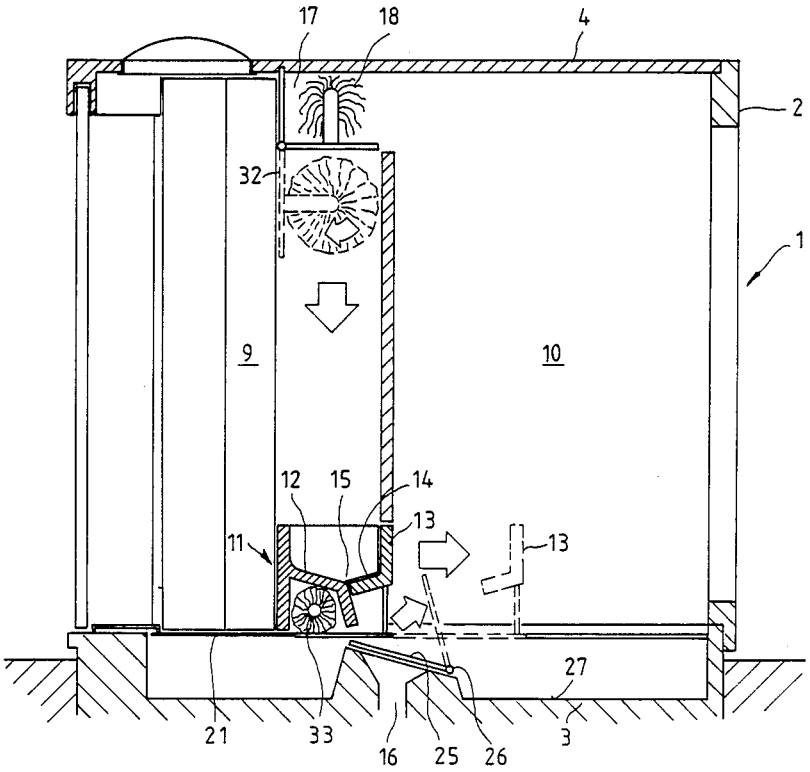
FIG. 3: A view similar to FIG. 1 of another embodiment of the sanitary cubicle.
Figure 4:
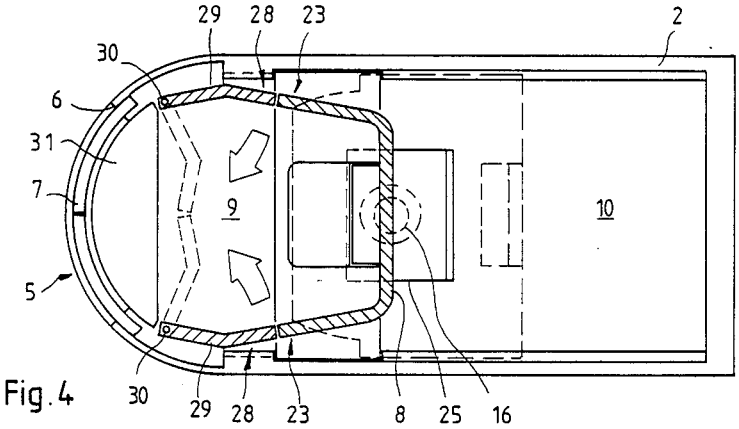
FIG. 4: A plan view relative to FIG. 3.

In the embodiment of FIGS. 3 and 4 the side walls 28 of the sanitary room are on the one hand formed by the fixed side wall parts 23 connected to the partition 8 and the front side wall parts 29 which are movable with respect to side wall parts 23 and are namely mounted on vertical spindles 30. In the position of use of the sanitary room 9, side wall parts 29 are in the position reproduced by the continuous lines. For the cleaning process the side wall parts 29 are swung inwards and forwards until they have reached the position indicated in broken line form in which they terminate the front area of the sanitary room 9, namely the access area 31. After reaching this position the rotary brush 18, whose chamber 17 in this embodiment is closed at the bottom by a hinged cover 32, following the pivoting of the same (broken line position) is moved downwards in order to clean the inside of partition 8 and the fixed side wall parts 23 connected thereto. Here again the rotary brush 18 is introduced into the water closet 11, so as to clean the inside thereof. In addition, the complete size-reduced inner area of the sanitary room 9 can be cleaned by spraying off with high pressure water. Finally, as a variant of the embodiment of FIGS. 1 and 2, below the water closet 11 is provided a further rotary brush 33, which in this case cleans the rearwardly moving floor 21.

Figure 5:
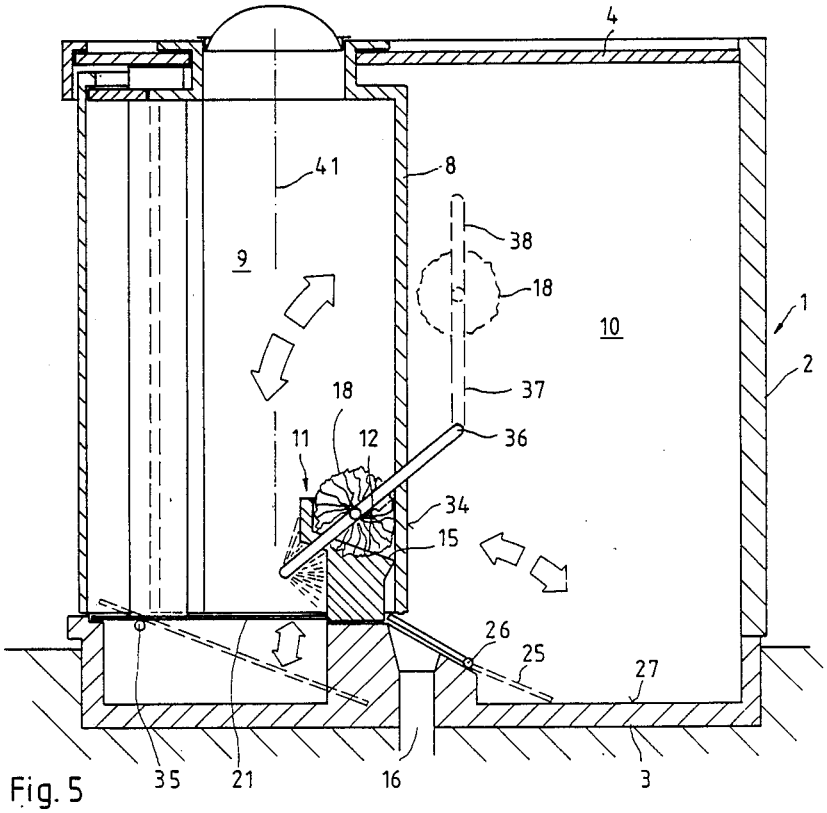
FIG. 5: A view corresponding to FIGS. 1 and 3 of a third embodiment of the sanitary cubicle.

In the embodiment according to FIG. 5 partition 8 with its bottom region 34 directly forms the rear termination of the water closet 11, which is once again equipped with a flat, rearwardly inclined base 12. Partition 34 engages on the rear drainage edge 15 of water closet 11. Unlike in the case of the aforementioned embodiments the front area of floor 21 is mounted on a horizontal spindle 35, so that its area close to the water closet 11 can be tilted rearwards and any coarse material thereon slides rearwards into the collecting trough 27 and for this purpose it is optionally possible to use an auxiliary appliance. Two parallel support arms 37 are arranged on a horizontal spindle 36 in the cleaning room 10 and between them is mounted a rotary brush 18. In addition, the support arms 37 have an extension 38 extending beyond the rotary brush 18 and which are optionally interconnected at their free ends. The support arms 37 with their extensions 38 either directly carry water or are used for fixing a water main issuing into water nozzles in the vicinity of the free ends of the extension 38 or the connection bridging the same.

Partition 8 is part of an overall cylinder 39, which in the use position of sanitary room 9 has a cutout 40 corresponding with the outer door 7. Cylinder 39 is rotatable about its vertical axis 41 and namely by at least 180°, so that after rotation cutout 40 faces the cleaning room 10. In this position the rotary brush 18 can be swung into the sanitary room, as shown in FIG. 5, until finally it engages into the water closet 11. As the lower portion 34 of partition 8 has been moved away, the content of the water closet before and during the cleaning process with the rotary brush 18 can pass over the rear drainage edge 15 into drain or outlet 16, whereby once again the coarse material is held back by means of grating 25. Simultaneously the outside of the water closet 11 is sprayed by means of the not shown water nozzles at the free ends of extension 38. The lower region 34 of partition 8 during the movement of the cylinder 39 can optionally move past a further, vertical brush and be cleaned.

Figure 6:
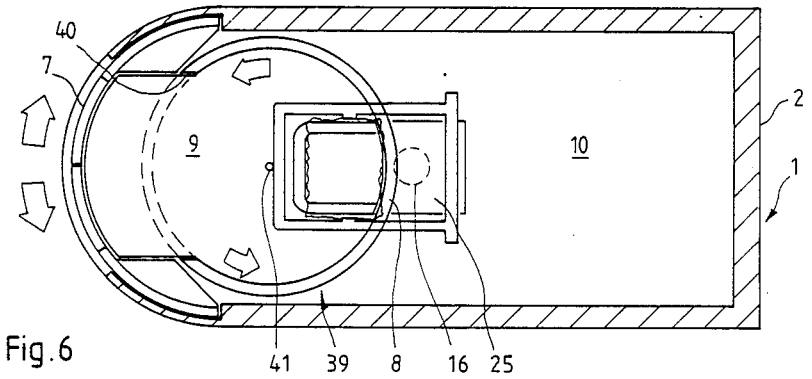
FIG. 6: A plan view in connection with the representation according to FIG. 5.
Figure 7:
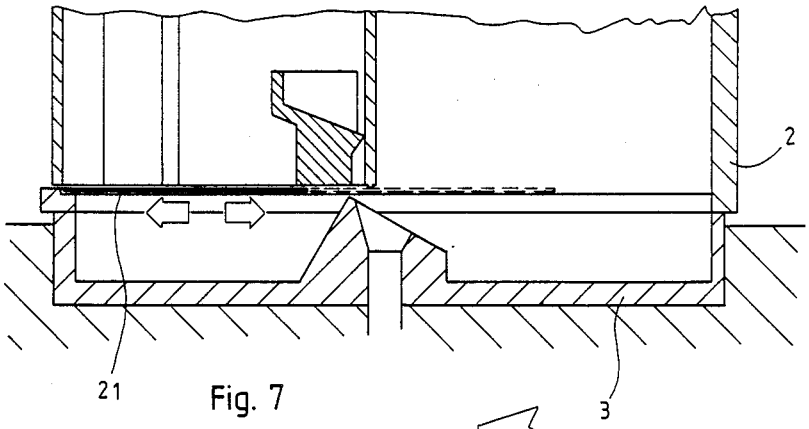
FIG. 7: A partial view corresponding to FIGS. 1, 3 and 5 of another embodiment of the sanitary cubicle.

The embodiment according to FIG. 7 essentially corresponds to that of FIGS. 5 and 6 with the difference that the floor 21, as in the embodiment according to FIGS. 1 to 4, can be moved rearwards.

Figure 8:
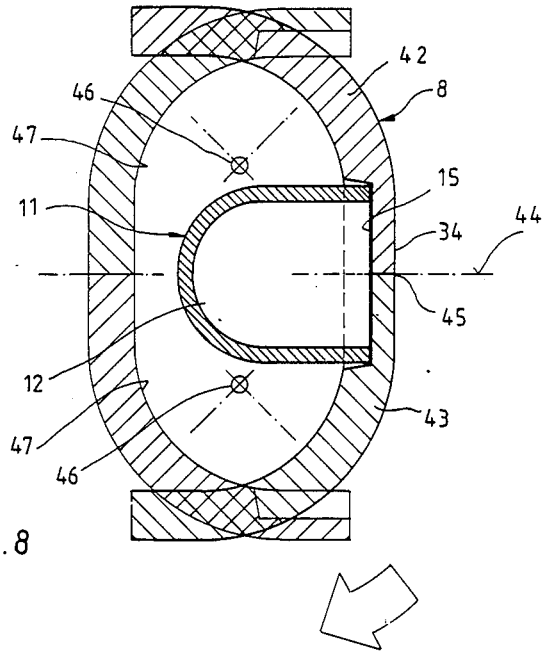
FIG. 8 A diagrammatic plan view of another embodiment limited to the area of the water closet of the sanitary cubicle.

FIG. 8 finally shows a detail plan view of another embodiment, in which the rear termination of the water closet 11 is again formed by a lower portion 34 of partition 8. For this purpose the partition is recessed in the lower region. As a modification of the aforementioned embodiments, partition 8 comprises two wall parts 42, 43, which abut at 45 along the vertical plane of symmetry 44 of water closet 11. Each partition part 42, 43 is mounted on a vertical spindle 46 and is pivotable about the same by an angle of 180° into the position reproduced in the drawing, in which the inside 47 face the cleaning room, so that they can be completely cleaned from there. During this movement the rear drainage edge 15 of water closet 11 is freed, so that the content thereof can pass rearwards into the not shown drain 16.

I claim:

1. Public sanitary cubicle comprising a sanitary room with a water closet accessible through an outer door and a cleaning room divided off by a partition from the sanitary room and which is provided with the means necessary for the supply, disposal and cleaning of the sanitary room and in particular a cleaning implement which can be brought up to the water closet after moving away the partition or a part thereof and a drain connected to the water closet, wherein the water closet has a substantially flat base downwardly inclined from the sanitary room to the partition and having a rear drainage edge and a rear wall formed by the partition or its movable part, and wherein the drain is located in the cleaning room in the vicinity of the partition below the drainage edge of the base of the water closet and is exposed by moving away the partition or its movable part.

2. Sanitary cubicle according to claim 1, wherein the lower area of the partition has the movable part, which at least has the size necessary for forming the rear wall of the water closet, said partition part being movable into the cleaning room whilst freeing the rear drainage edge of the water closet.

3. Sanitary cubicle according to claim 2, wherein the movable partition part is provided at its lower end with a portion inclined downwards into the sanitary room and which forms part of the base of the water closet and is connected by its leading edge to said drainage edge.

4. Sanitary cubicle according to claim 1, characterized in that the sanitary room has a movable floor, which for cleaning purposes can be tilted or moved in the direction of cleaning room.

5. Sanitary cubicle according to one of the claims 1 or 4, wherein the movable partition part, together with the floor of the sanitary room, can be moved in the direction of cleaning room.

6. Sanitary cubicle according to claim 5, wherein below the water closet extending to floor is provided a cleaning appliance for the floor moving away below it.

7. Sanitary cubicle according to claim 1, characterized wherein a grating for retaining coarse material is arranged above the drain.

8. Sanitary cubicle according to claim 7, wherein the grating is downwardly inclined into the cleaning room.

9. Sanitary cubicle according to one of claims 7 or 8, wherein the grating is pivotably mounted on the side remote from the water closet and can be pivoted from a position above the drain into the cleaning room towards the end of the cleaning process during the cleaning of water closet.

10. Sanitary cubicle according to one of the claims 1, 6, 7 or 8, wherein the partition is part of a cylinder forming the complete inner wall of the sanitary room and which in the sanitary cubicle is rotatable about its vertical spindle and has a cutout corresponding in the use position with the outer door and which faces the cleaning room in the cleaning position.

11. Sanitary cubicle according to claim 1, wherein the cleaning appliance for the water closet and the fixed partition and portions of a rear wall of the sanitary room laterally connected thereto is constituted by a rotary brush adapted to the contour of the aforementioned wall parts and which is movable along the same over the height of the sanitary cubicle.

12. Sanitary cubicle according to claim 11, wherein the rotary brush is arranged in a chamber above the ceiling of the sanitary room and can be lowered into the latter after opening a ceiling skylight.

13. Sanitary cubicle according to claim 11, wherein the rotary brush runs in guides on facing side walls of the sanitary room.

14. Sanitary cubicle according to claim 1 wherein the sanitary room comprises facing side walls which comprise in each case two cubicle-high wall parts, the two wall parts closest to the outer door are mounted on vertical spindles close to the outer door in such a way that in the use position of the sanitary room they are connected flush to the two other side wall parts, whilst they can be swung inwards until they abut with one another in the cleaning position and separate the access area of the sanitary cubicle with the outer door from the remaining sanitary room.

15. Sanitary cubicle according to claim 1, wherein the partition comprises two parts separated in the vertical plane of symmetry of the water closet, which are mounted on vertical spindles and are pivotable from the use position by 180° into the sanitary room in front of the water closet in such a way that the part of the sanitary room having the water closet is separated from the remainder thereof and is simultaneously opened to the cleaning room.

16. Sanitary cubicle according to claim 15, wherein the cleaning appliance for the water closet has a driven rotary brush located in cleaning room.

17. Sanitary cubicle according to one of the claim 16, characterized wherein the rotary brush is located between two support arms mounted in the cleaning room and which after moving away partition can be pivoted towards the water closet, the rotary brush engaging in the water closet (11).

18. Sanitary cubicle according to claim 17, wherein the support arms have an extension extending over and beyond the mounting support of the rotary brush and are constructed as a water duct and that the extensions or the connection bridging the same are located in front of the water closet in the cleaning position for cleaning the outside thereof.

19. Sanitary cubicle according to claim 1, wherein the cleaning room has a collecting trough for coarse material.

20. Sanitary cubicle according to claim 1, wherein the rotary brush (18) is mounted in the cleaning room level with the water closet and can be moved horizontally from the rear into water closet.

21. Sanitary cubicle according to claim 1, wherein a water high pressure pump is arranged in the cleaning room and several, optionally movably guided water nozzles are provided for spraying at least part of the inner wall of sanitary room.

* * * * *